United States Patent [19]

de Salazar

[11] 4,223,858

[45] Sep. 23, 1980

[54] BAG HOLDER

[76] Inventor: Gerardo P. de Salazar, Bosque de las Catarinas No. 28 Bosques de la Herradura, Mexico

[21] Appl. No.: 900,740

[22] Filed: Apr. 27, 1978

[51] Int. Cl.[2] ..... B65B 67/04

[52] U.S. Cl. ..... 248/101

[58] Field of Search ..... 248/99–101

[56] References Cited

U.S. PATENT DOCUMENTS

| | | | |
|---|---|---|---|
| 1,188,955 | 6/1916 | Leonard | 248/101 X |
| 2,421,740 | 6/1947 | Birch | 248/101 |
| 3,218,014 | 11/1965 | Frazier | 248/101 |
| 3,261,545 | 7/1966 | Frazier | 248/101 X |
| 3,818,956 | 6/1974 | Chamberlain | 248/99 X |
| 3,870,261 | 3/1975 | McSwain | 248/101 |

FOREIGN PATENT DOCUMENTS

| | | | |
|---|---|---|---|
| 1404302 | 8/1975 | United Kingdom | 248/101 |

*Primary Examiner*—James C. Mitchell

*Attorney, Agent, or Firm*—Craig and Antonelli

[57] ABSTRACT

A bag holder having outer and inner body portions which, as a result of their conformal nature and close cooperation, adequately support a bag while retaining the mouth of the bag in the open position, thereby rendering the interior of the bag accessible, by way of a passageway through the inner body portion, for the deposition of articles. The bag holder is directly mounted onto a suitable surface in a conventional manner. In one embodiment, the bag holder is hingedly attached to a mounting plate which is mounted to a suitable surface in a conventional manner.

13 Claims, 4 Drawing Figures

7
19
5
14
18
9a
10
4
16
6
8
14
3
9b
8
9a
15
11
12
17
2

1
22
20
9c
21
9b
23
15
9c
22
8
12
9a
14

BAG HOLDER

FIELD OF THE INVENTION

The present invention relates to a bag holder of simple design that may be easily affixed to a wall, car or truck-board or other similar structure. More specifically, the present invention presents a new means for the retention of a bag, with its mouth in the opened position, while offering as one of its additional features the quick and easy replacement of a filled bag.

BACKGROUND AND OBJECTS OF THE INVENTION

The quest to discover a bag holder of simple design capable of retaining the bag with its mouth in the opened position while providing for the simple and efficient replacement of a filled bag has led to the development of numerous types of apparatus attempting to fulfill these requirements. Representative patents in the general area of bag holders include U.S. Pat. Nos. 3,233,854; 3,529,766; 3,603,542; 3,684,225; 3,841,592; 3,861,630; 3,870,261; and 3,942,832. The vast majority of the above-listed prior art clearly demonstrates the two primary drawbacks with which bag holders have been confronted to date. The first of these difficulties is a lack of simplicity directly resulting in a tedious replacement operation when one is confronted with a filled bag. Prime examples of this problem are U.S. Pat. Nos. 3,233,854, wherein the difficulties encountered in loading the bag holder of this design with a fresh bag are revealed by the inclusion of small pins or spikes upon which the bag is impaled during the loading operation; U.S. Pat. No. 3,529,766, which utilizes multiple, entwined rods around which the bag mouth must be partially wrapped and a stop mechanism, all of which are substantially enclosed within a container to support and house the bag; U.S. Pat. No. 3,603,524, wherein an empty bag is loaded by wrapping the edge of its mouth around a loop which must first be pivoted upward and then lowered while the loader retains the bag mouth in place and U.S. Pat. No. 3,861,360, which requires the mouth of the bag to encircle a flexible loop with the loop then slipped over retaining members which are attached to a wall. Additionally, this design requires that the loop and bag members be separated and reunited via the encircling procedure during each loading.

A second drawback of the bag holder art has been the susceptibility of a loaded bag to unplanned detachment from the holding apparatus with a probable result being the scattering of the contents. Prime examples of this shortcoming are illustrated by U.S. Pat. No. 3,684,225, whereby the major means of bag retention is corner projections or abrasions on the bag retainer loop and U.S. Pat. Nos. 3,841,592 and 3,942,832, in which the bag is retained in its proper position by an elastic band cooperating with a firm grooved hoop support structure. Of course, the elastic band could easily become displaced or dislodged or, as a matter of fact, broken.

Accordingly, one important object of the present invention is to provide an improved bag holder which obviates these prior art difficulties.

Another important object of the present invention is to provide an improved bag holder a new means to maintain the bag in the open position yet not being susceptible to unintentional removal.

Another important object of the present invention is to provide an improved bag holder which may be both loaded and unloaded in a quick and easy manner.

Still a further object of the present invention is to provide a bag holder that is easily fabricated in different sizes and shapes and is also attachable to different means of support such as a wall or car dashboard.

Yet another object of the present invention is to provide a bag holder which is relatively simple in construction and that can be manufactured in a relatively inexpensive manner while being rugged in design.

SUMMARY OF THE INVENTION

In order to accomplish the above and other objects, the bag holder of the present invention generally comprises an outer body portion through which the mouth of the bag is passed and an inner body portion cooperating with the outer body portion to maintain the mouth of the bag in the opened position while supporting the bag along the circumference of its mouth by pressing and thereby retaining the bag between the inner and outer body portions. In one embodiment, the outer body portion is provided with a hinged lid. If it is not desired to attach the bag holder directly onto a surface, a mounting plate may first be attached to the surface by conventional methods. With the use of the mounting plate, the bag holder is attached to the mounting plate by conventional methods or, as disclosed in one embodiment, is hingedly connected to the mounting plate.

Other embodiments of the present invention incorporate stop means on the inner surface of the outer body portion cooperating with the outer surface of the inner body portion in a nesting manner to prevent the inadvertent descent of the inner body portion into the bag and/or gripping means on the inner surface of the inner body portion to assist in the loading and unloading operation.

The bag holder is constructed from any common metal or plastic material. It is preferable that the material from which the inner body portion is constructed be somewhat resilient so as to assist in the retaining action exerted upon the bag.

BRIEF DESCRIPTION OF THE DRAWINGS

Numerous other objects, features and advantages of the present invention will become apparent upon perusal and analysis of the following detailed description taken in conjunction with the following drawings, in which.

DETAILED DESCRIPTION

Figure 1:
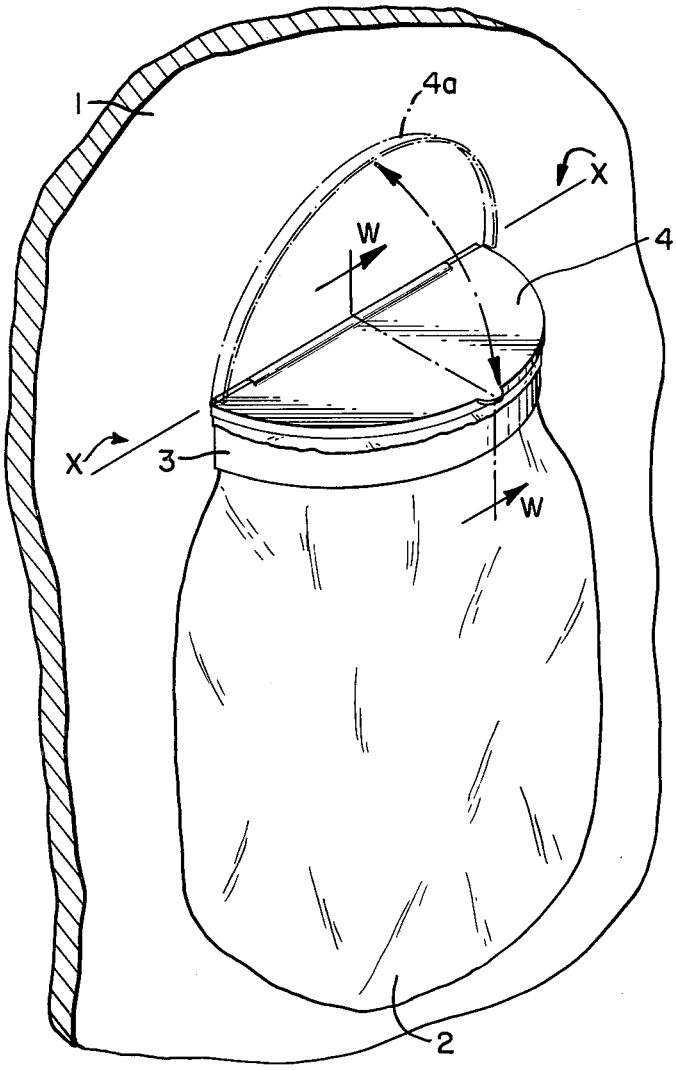
FIG. 1 is a perspective view of a preferred embodiment of the bag holder of this invention.

Referring to the drawings, FIG. 1 illustrates a perspective view of the bag holder of the present invention mounted on a surface 1 and holding a bag 2. The bag holder generally comprises an outer body portion 3 in a shape substantially similar to that of a closed semi-circle, with a lid 4 shaped in such a manner as to cover and conform to the outer body portion 3 and which is capable of being pivoted around axis X between the closed position 4 and the open position 4*a* and an inner body portion 5 which is hidden from view in FIG. 1.

Figure 2:
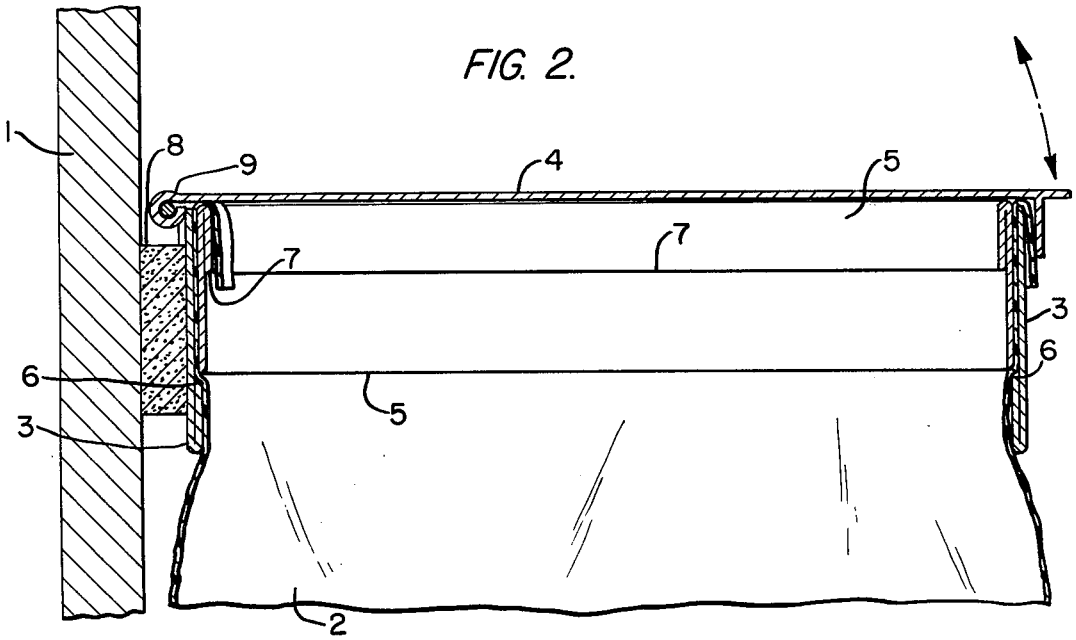
FIG. 2 is a cross-sectional view taken along line W—W of FIG. 1.

Referring now to FIG. 2, which is a cross-sectional view of the bag holder taken along the line W—W in FIG. 1, the presence of inner body portion 5, contained within and having an outer surface substantially conforming to the inner surface of outer body portion 3, while resting on stop ridge 6, is revealed. Inner body portion 5 is provided with a grip ridge 7 which assists in the removal of inner body portion 5 from its contact with the inner surface of outer body portion 3. A spacer block 8 separates the rear of the outer body portion 3 from the surface 1 so that lid 4 may freely pivot by way of hinge mechanism 9.

Figure 3:
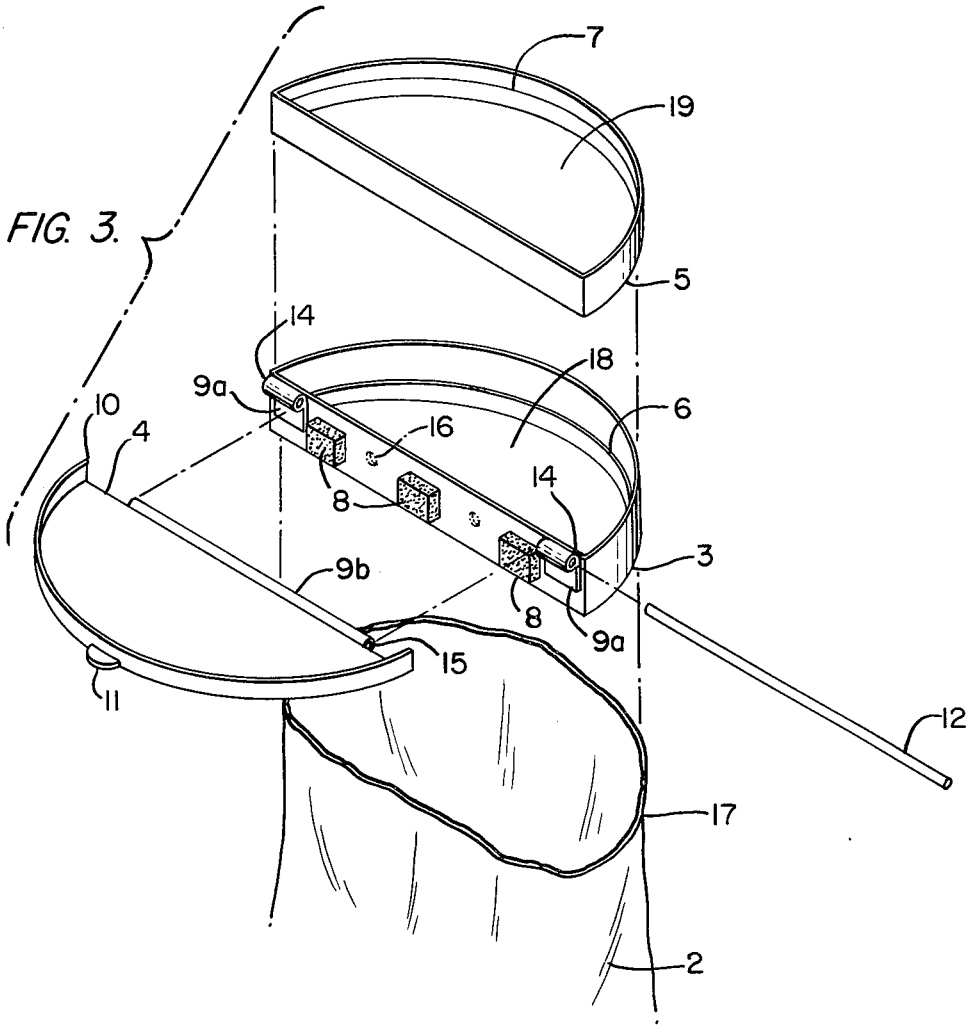
FIG. 3 is an expanded view of the various component parts of a preferred embodiment of the bag holder.

Referring to FIG. 3, which is an expanded view illustrating the various parts of the bag holder, the conformal nature of inner body portion 5 to the inner surface of outer body portion 3 is clearly seen as is the relationship of hinge brackets 9*a* and lid bracket 9*b* of hinge mechanism 9 to the hinge rod 12. Lid 4, which is provided with lip 10 and tab 11 is hingedly mounted to the outer body portion 3 by the insertion of hinge rod 12 through the aperture 14 in a hinge bracket 9*a* followed by the further insertion of hinge rod 12 through aperture 15 in lid bracket 9*b* and into the other aperture 14 of the other hinge bracket 9*a*. Once again, spacer blocks 8 are provided to allow for the free pivoting of the lid 4 about hinge rod 12.

The outer body portion 3 is mounted on a suitable surface by means well known in the art. The provision of holes 16 through which nails or screws may be inserted is one method by which the mounting procedure may be effectively accomplished. However, other means such as the application of an adhesive substance to the outer surface of spacer blocks 8 would suffice. Likewise, the mounting would be effected, with regard to a ferrous surface, if the spacer blocks 8 possessed magnetic qualities.

The general procedure which would be followed in loading an empty bag 2 into the bag holder is outlined in detail below.

With the lid 4 in the open position 4*a*, the mouth 17 of an empty bag 2 is inserted a distance into the aperture 18 of the outer body portion 3 whereby, at a minimum, the mouth 17 will be located above the stop ridge 6 with the outer side of the mouth 17 in close proximity to or touching that portion of the inner surface of the outer body portion 3 which is above the stop ridge 6. The loading act is easily completed by holding the bag in place with the fingers of one hand while simultaneously inserting the inner body portion 5 down into the outer body portion 3 and the mouth 17 until it rests upon the stop ridge 6. The bag is now firmly held between the inner and outer body portions with the mouth in the open position ready to receive trash by the means of passageway 19 through the inner body portion.

An alternate method of loading envisions the insertion of the mouth of the bag 17 entirely through the aperture 18 of the outer body portion 3 followed by the insertion of inner body portion 5 into the mouth of the bag 17. The inner body portion 5 with the bag mouth 17 firmly held thereto by the loader's fingers is then inserted into outer body portion 3 until it rests upon the stop ridge 6. It should be noted that the stop ridge 6 prevents the inadvertent disassembly of the bag holder due to the gravitational force exerted on the bag by virtue of its contents.

The method by which a filled bag is unloaded is quite simple. With the lid 4 in the open position 4*a* and the bag 2 in the grasp of the unloader, the unloader merely grasps the inner body portion 5 by placing his fingers on the grip ridge 7 and thumb on the external surface of the outer body portion 3. Upon the exertion of a slight upward force, the inner body portion will be freed from its cooperation with the outer body portion and the filled bag may be removed.

Figure 4:
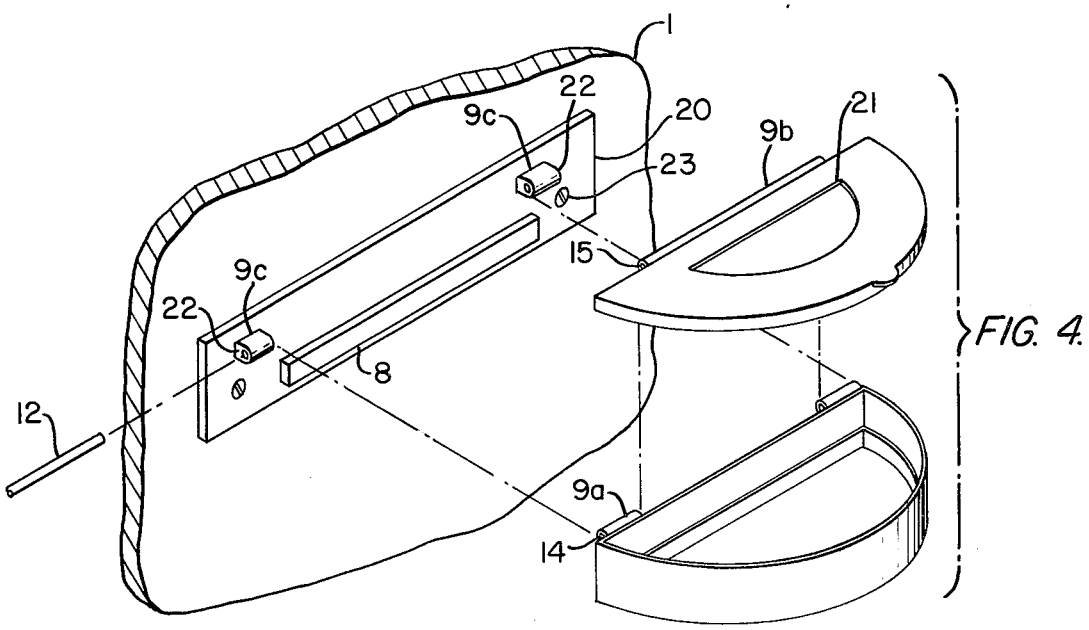
FIG. 4 shows an alternate means of attaching the bag holder to a suitable surface.

FIG. 4 illustrates yet another embodiment of the present invention whereby the bag holder is hingedly mounted to a suitable surface by means of a mounting plate 20. The mounting plate 20 comprises mounting plate brackets 9*c*, a spacer block 8, and a conventional means for the attachment of the mounting plate 20 to a suitable surface 1 which is represented by screws 23 which pass through holes in the mounting plate 20 and into surface 1. With the mounting plate suitably attached to a proper surface 1, hinge rod 12 is respectively passed through the aperture 22 in a mounting plate bracket 9*c*, the aperture 14 in hinge bracket 9*a*, the aperture 15 in lid bracket 9*b*, the other aperture 14 in the other hinge bracket 9*a* and the other aperture 22 in the other mounting plate bracket 9*c*. Spacer block 8 is provided to allow for the free pivotal movement of lid 4 about hinge rod 12. Additionally, FIG. 4 shows that lid 4 is provided with opening 21 through which small items may be deposited into the bag without the necessity of lifting the lid 4.

The bag holder of the present invention has many uses, some of which are in the home, office, hallways, automobiles or vans. Essentially, the bag holder may be effectively utilized wherever there is a substantially planar and vertical surface to which it may be attached.

Having described a few embodiments of the present invention, it should be apparent that numerous modifications of these embodiments can be made. It should be understood that all such modifications and alternative embodiments are within the spirit of the present invention and that, while a preferred embodiment has been described using specific terms, such description is for illustrative purposes only.

What is claimed is:

1. A bag holder comprising:

(a) an outer body portion provided with an aperture and thereby having an inner and outer surface, (b) an inner body portion provided with a passageway and having an outer surface adapted to cooperate with and conform to the inner surface of the outer body portion upon insertion of the inner body portion into the aperture of the outer body portion, and (c) means for hingedly attaching the outer body portion to a surface, whereby, upon the insertion of a mouth of a bag into the aperture of the outer body portion and the inner body portion within both the mouth of the bag and the outer body portion, the bag is supported with the mouth of the bag in an open position with an interior of the bag being accessible by the passageway through the inner body portion.

2. The bag holder of claim 1, wherein the outer body portion is provided with a hingedly mounted lid.

3. The bag holder of claim 1, wherein the shape of the outer and inner body portions is substantially a closed semi-circle.

4. The bag holder of claim 1, wherein the attachment means comprise at least one spacer block.

5. The bag holder of claim 1, wherein said attachment means comprise a mounting plate.

6. The bag holder of claim 5, wherein means are provided for hingedly mounting the bag holder to the mounting plate.

7. The bag holder of claim 5, wherein said attachment means further comprise at least one spacer block.

8. The bag holder of claim 1 or 2 or 3 or 4 or 5 or 6 or 7, wherein the passageway through the inner body portion is provided with grip means.

9. The bag holder of claim 8, wherein the gripping means is a ridge.

10. The bag holder of claim 1 or 2 or 3 or 4 or 5 or 6 or 7, wherein the inner surface of the outer body portion is provided with stop means to prevent the inadvertent disengagement of the outer and inner body portions.

11. The bag holder of claim 10, wherein the stop means is a ridge.

12. The bag holder of claim 11, wherein a surface of the passageway through the inner body portion is provided with gripping means.

13. The bag holder of claim 12, wherein the gripping means is a ridge.

* * * * *